United States Patent [19]

Guillon

[11] Patent Number: 4,971,476

[45] Date of Patent: Nov. 20, 1990

[54] ROAD RETREATMENT PLANT

[75] Inventor: Roger Guillon, Arras, France

[73] Assignee: Beugnet, Arras, France

[21] Appl. No.: 284,928

[22] Filed: Dec. 15, 1988

Related U.S. Application Data

[63] Continuation-in-part of Ser. No. 22,731, Mar. 6, 1987, abandoned.

[51] Int. Cl.[5] ..... E01C 19/00

[52] U.S. Cl. ..... 404/91; 404/92

[58] Field of Search ..... 404/81, 90–92, 404/101, 111, 113, 118; 299/39

[56] References Cited

U.S. PATENT DOCUMENTS

| | | | |
|---|---|---|---|
| 2,069,376 | 2/1937 | Madsen | 404/92 |
| 2,181,320 | 11/1939 | Flynn | 404/92 |
| 3,241,976 | 3/1966 | Rank et al. | 404/111 |
| 4,139,318 | 2/1979 | Jakob et al. | 404/90 |
| 4,272,212 | 6/1981 | Bauer, Jr. et al. | 404/91 X |
| 4,325,580 | 4/1982 | Swisher, Jr. et al. | 299/39 |
| 4,342,485 | 8/1982 | Tuneblom | 299/39 |
| 4,453,856 | 6/1984 | Chiostri et al. | 404/91 |
| 4,473,320 | 9/1984 | Register | 404/91 |
| 4,704,045 | 11/1987 | Taylor et al. | 404/90 |
| 4,720,207 | 1/1988 | Salani | 404/90 |

*Primary Examiner*—Ramon S. Britts

*Assistant Examiner*—Matthew Smith

*Attorney, Agent, or Firm*—Clifford A. Poff

[57] ABSTRACT

A road reconditioning plant for excavating an existing roadway and using excavated roadway material for forming a renewed roadway, the road reconditioning plant includes; an excavator capable of releasing existing roadway material to a depth of at least about 25 cm while subdividing released material to form aggregate and a chassis for carrying the excavator for advancing movement along the roadway; a drive for advancing the chassis along the existing roadway; an adjustable leveling jack on the chassis remote from the excavator for positioning the excavator to excavate roadway material to a depth of at least about 25 cm; a housing including a blade member spaced from the excavator for forming a segregating chamber wherein released roadway material can pass in a downstream direction beyond the excavator; a blender for receiving aggregate discharge for the excavator, the blender receives cement and water for forming a binder to be blended with aggregate while advanced rearwardly along the chassis in relation to the direction of forward advancing movement by the chassis; and a discharge device at the rear portion of the chassis for discharging blended aggregate and binder from the blender onto the excavated roadway.

16 Claims, 6 Drawing Sheets

ROAD RETREATMENT PLANT

This application is a continuation-in-part of Ser. No. 022,731 filed Mar. 6, 1987, Entitled: ROAD RECONDITIONING PLANT, in the name of Roger Guillon, now abandoned.

BACKGROUND OF THE INVENTION

1. Field of the Invention:

The present invention relates to a road retreatment plant and, more particularly, to such a plant embodying a construction and arrangement of parts to enable reconditioning of a roadway comprised of a plurality of layers to a total depth of up to 33 centimeters and mixing the recovered aggregate material with a binder comprised of cement or an emulation of bituminous to form a replacement roadway.

2. Description of the Prior Art:

There exists today a need for increasing the strength of roadways to accommodate a very substantial growth of roadway traffic, particularly heavy vehicles, such as trucks, and to meet the requirements for establishing a roadway network that is unaffected by sub-freezing temperatures, i.e., frost free. Heretofore, solutions proposed for increasing the strength of the roadway merely extended the useable life of the roadway by a few years without insuring a suitable increase to the strength of the roadway bed. In order to overcome the short comings, research has been undertaken to develop a retreatment plant capable of retreating a roadway bed to effectively increase the strength of the road bed for a very long period of time and at a limited cost which is substantially lower in the majority of instances than the cost of only roadway maintenance work.

In French Pat. No. 85 12 724 there is disclosed a device intended to move over a roadway to be reconditioned. The device spreads a layer of binder, in particular cement and water, on the worn roadway then excavates the binder and roadway material to a predetermined depth which is subdivided and crushed to form aggregate before the entire mixture is mixed. After mixing is completed, the mixture of aggregate and binder is spread onto the excavation sight to form a replacement roadway. The device consists of a self propelled vehicle having thereon beginning at the forward portion of the vehicle, a sequential arrangement of a cement batcher, a excavating unit situated in a segregated chamber to break-up the roadway material which is to be treated, a sizing grid, and a mixer unit. Despite obvious advantages of such a machine, the machine did not operate in a manner to produce the results which were expected and desired. Highly efficient mixing of the aggregate and binder is necessary and essential for the production of a reconditioned road bed in order to impart a homogenous, stable, and above all a road bed impervious to frost.

SUMMARY OF THE INVENTION

It is an object of the present invention to provide an improvement to known devices for reconditioning existing material comprising a roadbed by the development of a road reconditioning plant which is capable of blending excavated material from the existing road bed with a binder to produce the optimum blend for comprising the reconditioned road bed material.

The present invention provides a road reconditioning plant which is capable of moving along an existing roadway, and if desired, spreading on the existing roadway a layer of binder, such as cement, the reconditioning plant being operative to excavate the existing roadway to a depth of at least 25 cm or a greater depth, by which not only is a roadway covering and base layer excavated; but also at least part of a foundation layer is excavated; the excavated material is subdivided to form aggregate and mixed thoroughly with binder to form homogenized mixture which is thereafter distributed on the excavation site of the roadway to form a renewed road bed.

More particularly according to the present invention, the reconditioning plant is made up of a sequential arrangement with respect to the direction of movement by the plant of a excavating unit situated in a segregation chamber to break-up the material comprising discrete layers of the existing road bed material to a depth of at least 25 centimeters and a blender unit to homogenize aggregate supplied from the excavation unit and a binder at a site in the plant which is downstream of the excavating unit. The blender unit includes blender arms having end portions provided with interchangeable blades and a spiral arrangement of blender arms along a drive shaft capable of blending and delivering the blended aggregate and binder obtained from the excavating unit and binder toward the rear of the reconditioning plant.

It has been found that combining an excavating unit with a blender unit located lengthwise of the reconditioning plant having the features enumerated above, according to the present invention, was necessary to achieve, upon completion of the retreatment of the roadway material a successfully reconditioned roadway. Another feature of the present invention provides that the excavating unit includes a drive tube extending transversely of the machine relative to the direction of advancing movement by the plant. A spiral member or helix is welded to the drive tube between a ring member at each end of the tube. The spiral member and rings are provided with teeth, preferably carbite, one series of teeth is secured to the periphery of the helix, while the other series of teeth is carried by segments which are removably attached to the outer peripheral portion of the ring member. In order to insure successful results, the spiral has an elongated length between the ring member which matches the width, the roadway retreatment of the plant. The spiral is constructed from a high strength plate. The excavating unit is located in a segregating chamber equipped with segregating blades which restrict the flow of recovered roadway material between the excavating unit and the housing so as to allow crushing of softer materials recovered from the roadway. The segregating chamber preferably includes at its front end injectors for water capable of adding a predetermined amount of water to cement and aggregate in the segregation chamber and to cool the teeth. Thereafter, according to the present invention, the spiral shaped member of the excavating unit mixes the combined aggregate, cement and water, while conveying these materials rearwardly of the reconditioning plant. According to a further feature of the present invention, the blender unit situated rearwardly i.e., at a trailing position with respect to the advancing movement by the plant of the segregating chamber, is arranged so that the drive shaft of the blender unit extends parallel to the direction of advancing movement by the reconditioning plant whereby the extended length of the blender unit is sufficient to achieve the necessary blending of the aggregate and binder before respreading on the excavated roadway. The reconditioning plant of the present invention provides a further feature in a form of a spreader screw situated transversely relative to the direction of travel by the reconditioning plant and mounted rearwardly of the blender unit for spreading the blended aggregate and binder supplied by blender unit. The spreader screw is operative in conjunction with a leveling blade which is adjustable to produce a predetermined depth of the homogenized mixture of aggregate and binder during the re-spreading in the excavated site of the roadway.

According to the present invention the motor of the blender, the spreader screw, and the leveling blade are operated and controlled at ground level by an operator, a second operator controls the forward advancing movement of the overall plant. In order to improve the performance of the reconditioning plant of the present invention, provision is made for an automatic leveling system to insure the depth of pass, the quality of the longitudinal section of the excavated road bed and the gradient of the latter. The present invention provides the further feature that the blender unit, spreader screw and leveling blades are mounted on a carriage capable of being moved lengthwise of the plant i.e., parallel to the direction of advancing movement by the plant, in order to provide access to the mixing motor and for clean-up operations.

Another feature of the present invention provides that a binder such as cement is dispensed by the use of proportioning cells. The cells are formed in a housing having a generally tubular shape and provided with a housing section which can be opened quickly to provide access to the proportioning cells for regular cleaning and to insure accurate proportioning of the binder. Ease of access to the proportioning cells is essential for insuring trouble-free operation of the reconditioning plant. The successful reconditioning of a road bed requires the suitable control for achieving an adequate adjustment to the quantity of cement or other binder which can be spread over the width of the roadway before operation of the excavation unit takes place. The present invention embodies a design of equipment to allow complete adjustment to the quantity of hydraulic or bituminous binder, preferably cement, that is supplied as a function of the particular composition of the roadway to be reconditioned as well as the speed at which the reconditioning plant advances along the roadway.

To this end, according to a further feature of the present invention, the reconditioning plant for a roadway includes two chassis arranged one behind another with respect to the direction of travel by the plant is along the roadway. The first chassis which is situated upstream of the second chassis, is mounted on wheels capable of advancing movement along the roadway while carrying a dispenser for a binder, such as cement, which is connected to communicate with a storage hopper, a water tank connected to a proportioning discharge pump, motors for driving the cement dispenser and water proportioning pump and a central controlled unit including a control facility responsive to a forward speed of advancement by the first chassis for controlling the quantities of binder, supplied per square meter of roadway. The second chassis is supported by leveling jacks on drive gear by which the excavation depth is controlled as the chassis is advanced along the roadway. The second chassis carries the excavating, the blending, and spreading units.

The subdivision of the components making up the reconditioning plant between two separate chassis improves the control of the amount of binder delivered by the discharge device. The terms cement and water are to be broadly construed because all hydraulic binders capable of being used for the reconditioning of roadways can be utilized in the plant of the present invention. The cement dispenser could be used to supply cement, lime, slag, fly ash, or other powdered material. The proportioning pump is equally useful to deliver a desired proportion of bituminous binder, a regeneration binder, or an emulation. The reconditioning plant of the present invention offers a major saving to cost and power requirements because materials from the original roadway are reused, thus avoiding the cost of disposal for the worn material of the roadway and transporting new material to reconstruct the roadway as well as the nuisance caused by such transportation of the materials. The invention allow a considerable reduction to the time required to reconstruct the roadway.

BRIEF DESCRIPTION OF THE DRAWINGS

These features and advantages of the present invention as well as others will be more fully understood when the following description is read in light of the accompanying drawings in which.

DETAILED DESCRIPTION OF THE PREFERRED EMBODIMENT

Figure 10:
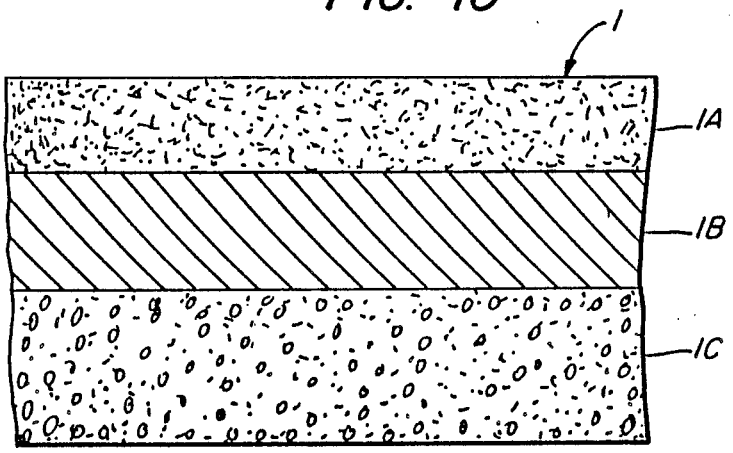
FIG. 10 is a partial sectional view of components forming a typical roadway which can be reconditioned through the use of the plant of the present invention.

Roadway reconditioning facilities known in the art are designed to operate by removing a roadway covering generally made up of a top roadway layer of asphalt that is between two and six centimeters thick. Sometimes the reconditioning operation removes the top roadway layer and a shallow part of a base layer that is between four and ten centimeters thick. Unlike these known roadway reconditioning plants, the present invention is designed to remove roadway material to much greater depths than heretofore contemplated or believed possible. As shown, for example in FIG. 10, the present invention is operative to recover from an existing roadway three constitute parts comprising the roadway. The top roadway layer is identified by reference numeral IA and comprises the roadway covering. This covering is, as just explained, between two and six centimeters thick. The roadway covering is typically comprised of asphalt. Underlying the layer IA is the base layer IB which is typically between four and ten centimeters thick. This base layer may also comprise asphalt, but usually includes coarse aggregate with a bituminous binder. Underlying the base layer IB is a foundation layer 1C which is typically between 20 and 30 centimeters thick, and is made up of very coarse aggregate and a binder. A total thickness of the roadway bed which is operated upon by the apparatus of the present invention is between 25 and 35 centimeters. By excavating roadways to such a depth, the reconditioned roadway is effectively strengthened for a long continued integrally, and at the same time, the reconditioned roadway is rendered impervious to a subfreezing climate.

Figure 1:
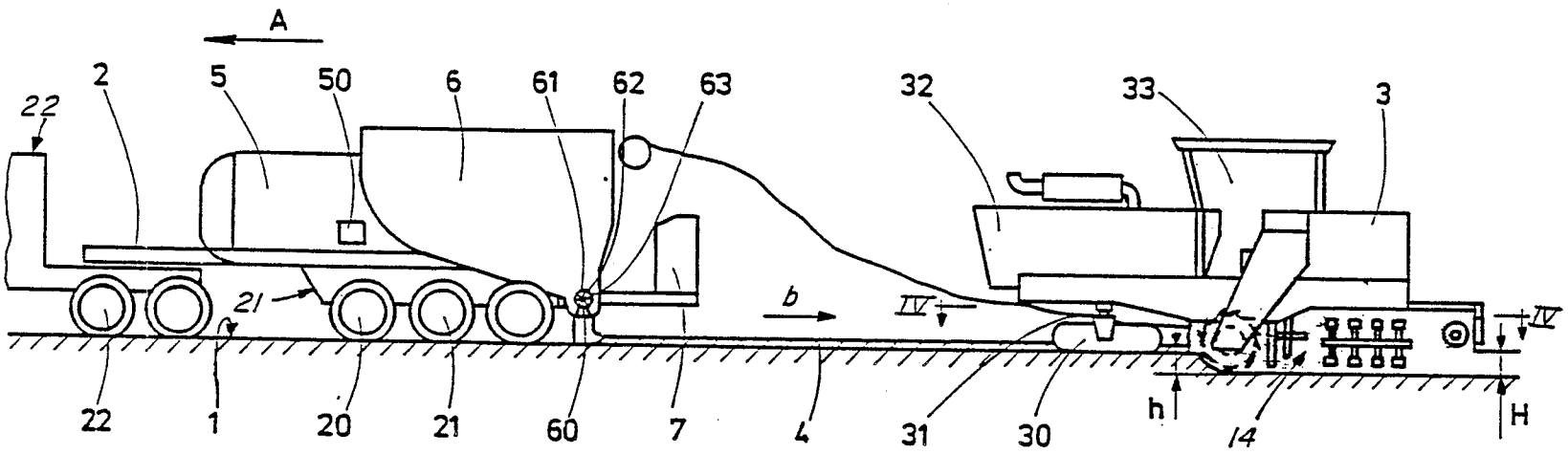
FIG. 1 is an elevational view illustrating an arrangement of the vehicular components forming the roadway reconditioning of the present invention.
Figure 2:
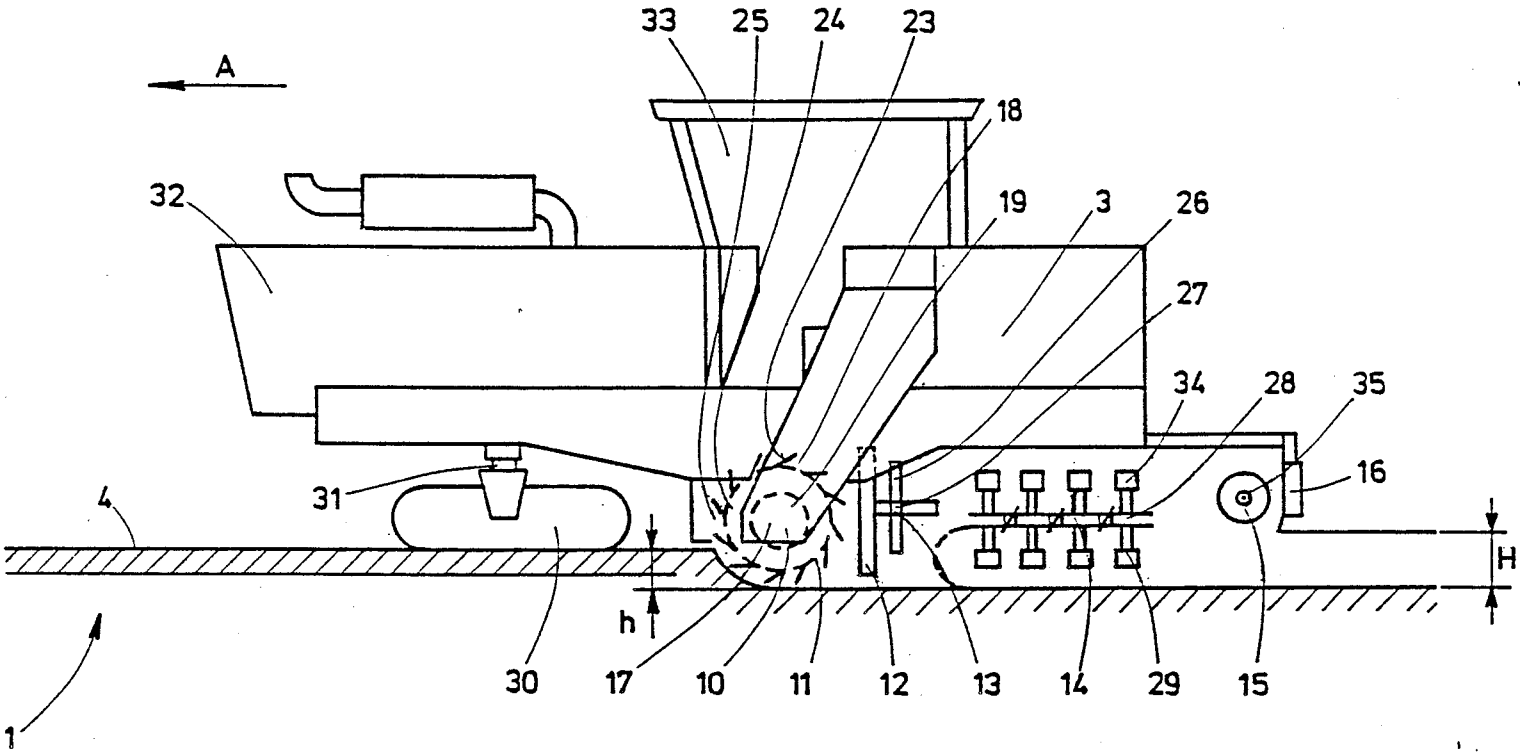
FIG. 2 is an enlarged schematic view of the second trailing component parts being illustrated.

Turning now to FIG. 1, the roadway reconditioning plant of the present invention is capable of advancing movement along a roadway 1 in a direction indicated by an arrow identified by reference character A. The plant is made up of a first chassis 2 having wheel assemblies 20 that are part of a three axial semi-trailer 21 pulled by a tractor 22. This arrangement of a vehicle can be changed without departing from the scope of the present invention. The first chassis is advanced along a roadway for the purpose of spreading predetermined quantities of a binder forming a layer 4 across the full width of the roadway 1 which is to be reconditioned by advancing movement of the plant. The first chassis 2 supports a water tank 5, which can, for illustrated purposes, have a typical capacity of 15 cubic meters. Situated behind the water tank on the chassis 2 is a hopper 6 containing a supply of binder, such as cement. Typically the hopper 6 may have a capacity of 20 tons. Water is withdrawn from tank 5 by operation of a control system that will be described hereinafter. Cement is withdrawn from the hopper through operation of apparatus situated at an outlet in the bottom of the hopper.

Figure 7:
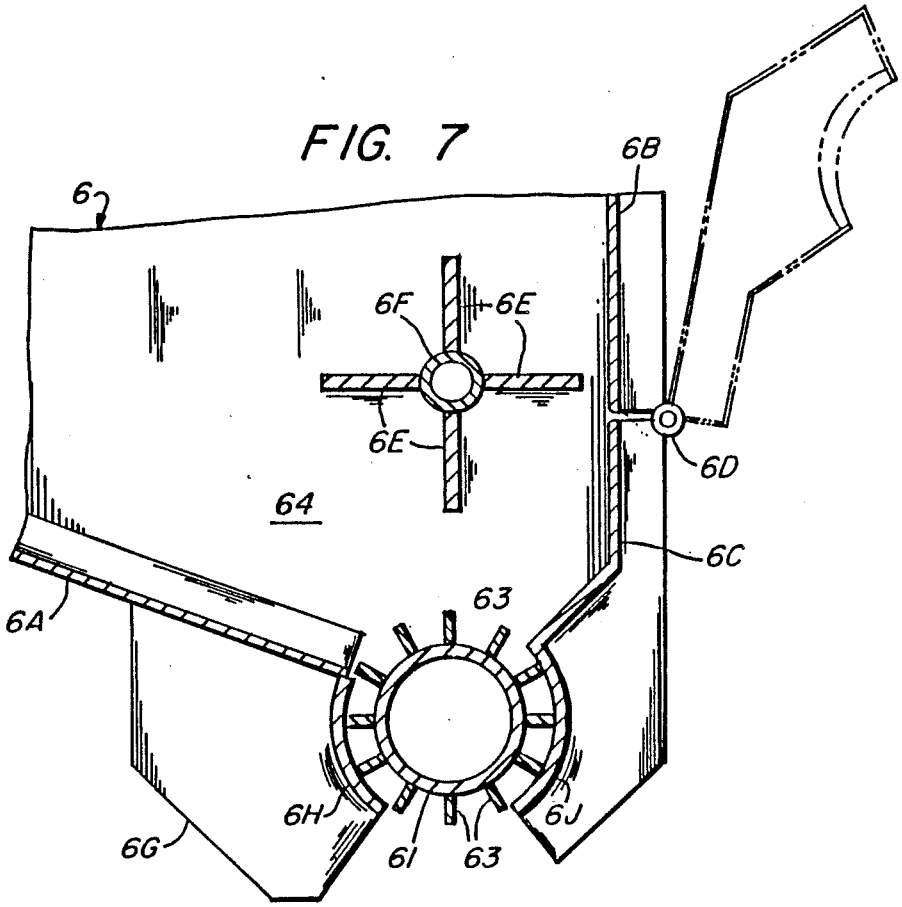
FIG. 7 is an enlarged elevational view of a cement dispenser as shown in FIG. 1.

As shown in FIG. 7, the hopper includes a bottom wall 6A surrounded by sidewall 6B. An opening is formed in the bottom wall 6B at a site which is adjacent to a sidewall 6B, where a sidewall is provided with a sidewall segment 6C connected to sidewall 6B by a hinge 6D. It is to be understood that the width of the hopper at the discharge opening corresponds to the width of the roadway which is to receive the predetermined quantity of cement to form layer 4 thereon. Above the discharge opening in the hopper 6 is a agitator assembly made up of blades 6E secured to a drive tube 6F extending between opposed sidewalls of a hopper to agitate the cement immediately above the discharge site where a fluidized bed condition is imparted to the cement at a site identified by reference numeral 64. Protruding downwardly from a bottom wall 6A is a bracket 6G which supports a tube segment 6H opposite to which there is a further tube segment 6J attached to the sidewall segment. In the space between the tube segments 6H and 6J there is arranged a drive tube 61 having bars 63 affixed to the outer peripheral surface thereof at equally spaced sites to form proportioning cells which, when directed toward the cement storage compartment of the hopper are filled with cement. Drive tube 61 can be rotated to advance the cells along tube segment 6J thereby establishing predetermined quantity of cement comprising the cell. As the cell is advanced beyond the tube segment 6J, the cement in the individual cell is released from the cell for passage onto the roadway. The component parts forming the proportioning cells are robust to form a rigid assembly to insure each cell is filled with a predetermined quantity of cement. The distance longitudinal bars 63 project radially from the drive tube 61 is selected to minimize the clearance between the bars and tube segments 6H and 6J and thereby avoid an uncontrolled flow of cement from the hopper. The cement is supplied to the proportioning cells by a gravity flow and under conditions established by the fluidized bed, in the hopper. The large volume of the cement in the hopper 6 permits the release of air which is used to convey the cement to the hopper without disturbing the continuous filling of the proportioning cells.

Figure 8:
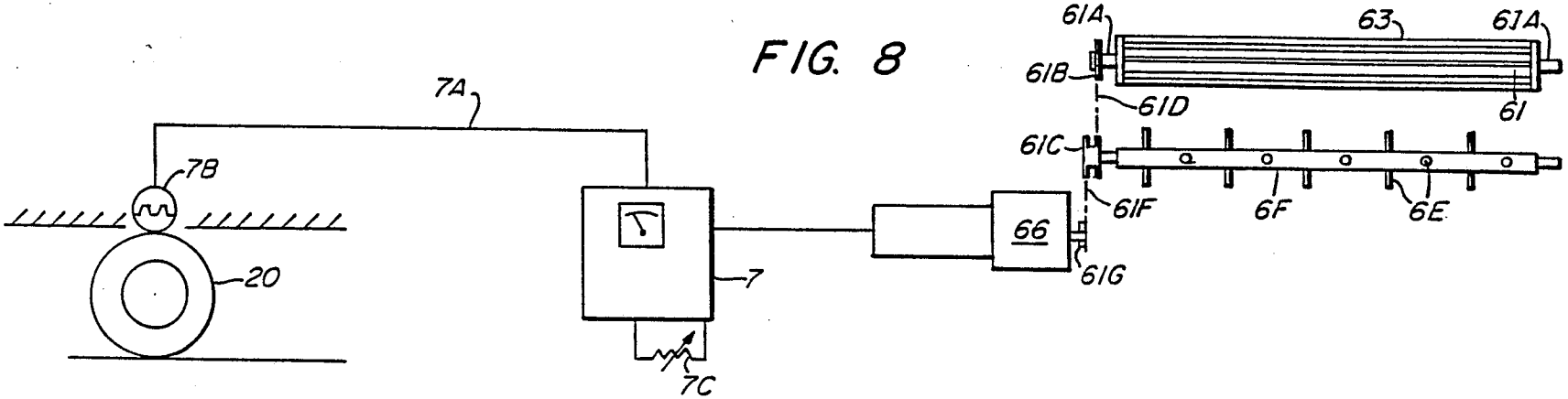
FIG. 8 is a schematic illustration of a drive and control the cement dispenser shown in FIGS. 1 and 7.

Drive tube 61 is driven by an arrangement of parts shown in FIG. 8 and for this purpose extending from drive tube 61 at its opposite ends are support shafts 61A which are used to rotatably support the shaft. Secured to one of the support shaft is a sprocket 61B which is connected to one sprocket of a double sprocket 61C by a transmission chain 61D. The double sprocket 61C is mounted on a shaft portion of drive tube 6F which is part of the agitator. A second sprocket of double sprocket 61C is connected by a transmission chain 61F to a sprocket 61G that is mounted on the output shaft of a variable speed motor 66. The rotational speed of tube 61 is controlled by a central control unit 7 connected by wiring to motor 66. The control unit 7 received an input signal through line 7A which extends to a transducer 7B that is driven by a wheel 20 of the semi-trailer 21. Thus it can be seen that through the operation of the control unit 7, the output signal fed to the motor 66 is responsive to the forward speed of the chassis 2 so as to insure that the predetermined quantity of cement is supplied per square meter of roadway. The operation of the control unit 7 is responsive to a further input signal provided by a potentiometer, for example, which is identified by reference numeral 7C. The provision of potentiometer enables the operator to control the thickness of layer 4 independently of the speed of advancing movement by the road reconditioning plant. Provisions can also be made to provide an operator with a continuous visual indication of the height of the quantity of the cement in the hopper 6. The water tank 5 and the cement hopper 6 are both preferably provided with probes operative to respond to low level conditions of water and cement, respectively. The probes are connected to the central control unit 7 to enable the control unit to stop advancing movement of the tractor 22 in the event the supply of water or cement is exhausted.

Figure 6:
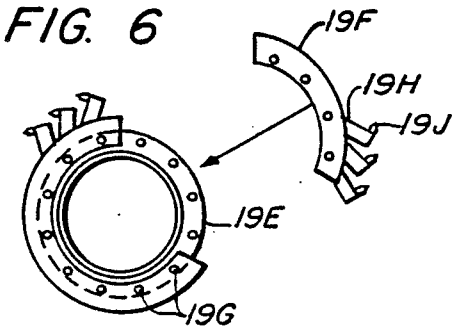
FIG. 6 is a sectional view taken along lines VI—VI of FIG. 5.
Figure 5:
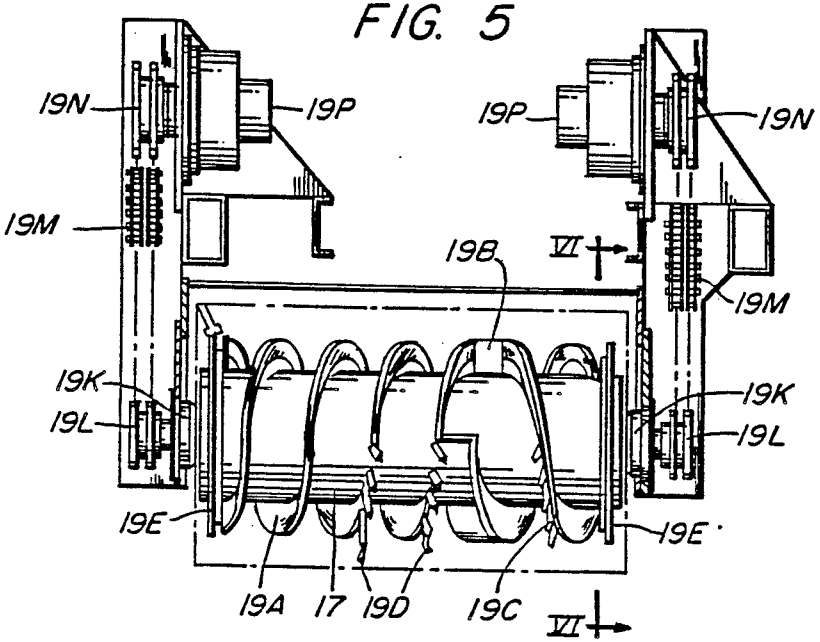
FIG. 5 is an enlarged plan view, partly in section of a rotary excavator as shown in FIGS. 1 and 4.
Figure 3:
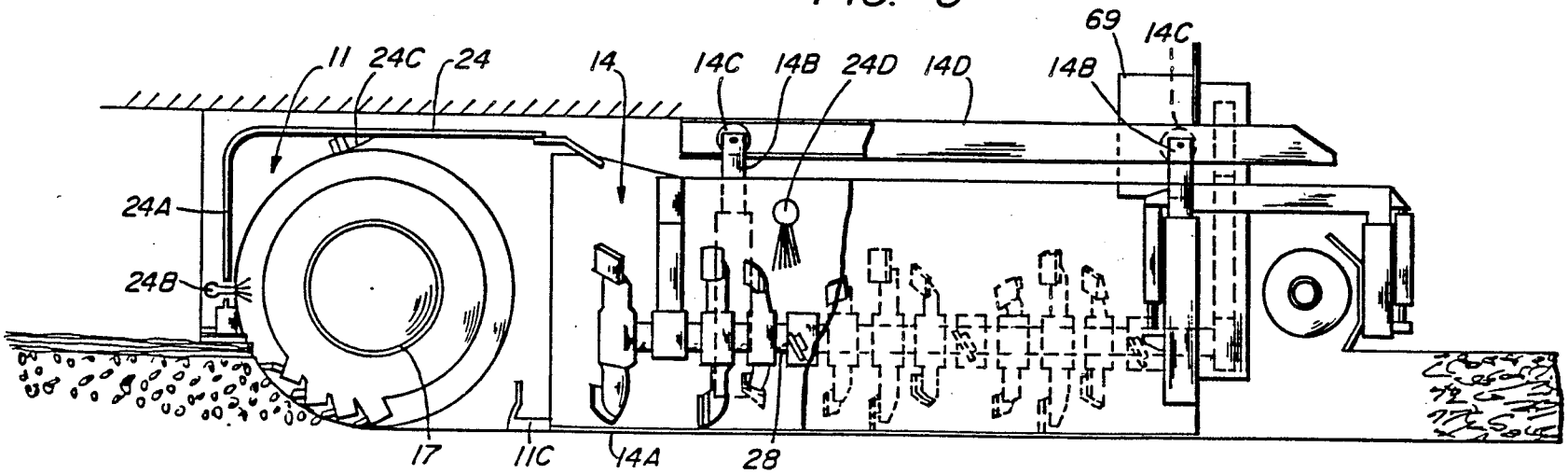
FIG. 3 is an enlarged elevational view showing in greater detail the roadway material processing equipment shown in FIG. 2.
Figure 4:
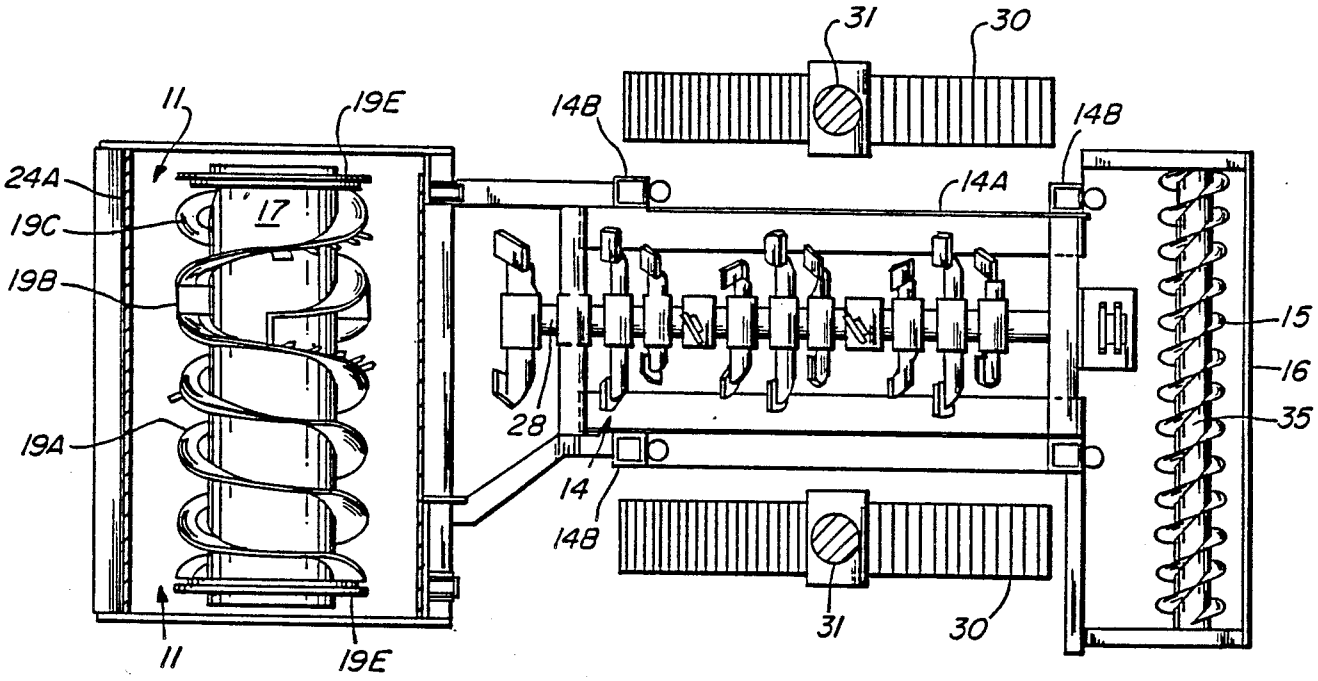
FIG. 4 is an enlarged plan view in section taken along line IV—IV of FIG. 1.

The water or other hydrocarbon binder is discharged flow from tank 5 by a conduit extending from the rear portion of chassis 2 to a second chassis 3 which operates in a trailing fashion behind chassis 2 to excavate the roadway 1 to a predetermined depth that interconnect the chassis with running gear 30. Devices now to be explained are situated on chassis 3 to excavate roadway material; crush and partly mix the broken roadway material with cement and part of the required water to form aggregate homogenize this mixture while adding a further quantity of water and finally respread the homogenized mixture on the highway at the rear of chassis 3 to form a roadway bed having a predetermined thickness identified by reference numeral H which preferably corresponds to the excavated depth of the original roadway layers. The depth of excavation of the roadway is 15 established by operation of leveling jacks 31. The second chassis 3 is part of a self-propelled vehicle which includes an engine 32 and a drive cab 33. As shown in FIGS. 2-6 the chassis 3 also includes a sequential arrangement of a excavating unit 10 which operates in a housing wherein a segregating chamber 11 is formed and downstream thereof in relation to the direction of advancing movement by chassis 3 there is located a blender unit 14 and downstream thereof is a spreader screw 15 followed by a leveling blade 16. The excavating unit 10 is formed by a excavating drive drum 17 which extends transversely across the chassis 3 at right angles to the forward direction of advancing movement by the chassis indicated in FIG. 2 by an arrow identified with reference character A. As shown in FIGS. 3 and 6, a spiral shaped plate is arranged to protrude from the outer periphery of drum 17 and attached by weld material. The spiral configuration is made up of a first spiral shaped plate 19A that extends to a reversely bent plate 19B from which there extends a second spiral shaped plate 19C. As can be seen the spiral section 19A is made up of a spiral configuration which is the reverse of the spiral configuration of section 19C. Also, the length of the drum occupied by spiral section 19A is much greater than the length of the tube occupied by spiral section 19C. The projected edges of spiral sections 19A and 19C are each provided with spaced apart cutter elements 19D that are welded or other wise secured to the spiral section. The spiral sections extend between circular plates 19E which are welded to the opposite end portions of the drum 17. As shown in FIG. 6, an important feature of the present invention is the use of the circular plates 19E for carrying a complement making up 360 degrees, of arcuate segments 19F which are attached to the circular plate by bolt and nut assemblies 19G. The segments 19F each include a series of holders 19H which receive cutter elements 19J that can be quickly and easily removed from the holders when the cutter elements wear to the point requiring replacement. The cutting rotor is provided with journals extending from opposite ends of the drum. The journals are supported by bearing assemblies 19K that are in turn supported by the frame of the chassis 3. End portions of the journals projecting from the bearing assemblies are provided with sprockets 19L. Transmission chains 19M extend from the sprockets 19L to sprockets 19N mounted on the drive output shaft of motors 19P which can be in the form of hydraulically powered motors. The motors are supported by frame parts of the chassis 3. Rotation of the excavating unit operates to cut-away the existing roadway layers to the required depth which is adjustably selected by operation of leveling jacks 31 supported by the chassis and connected to a mounting frame for running gear 30. The leveling jacks 31 and running gear 30 are situated in the forward and rear portions of the chassis. In the preferred embodiment, is a single running gear situated at the forward center of the chassis. The same form of running gear is provided at the rear portion of the chassis at each of the opposite sides of the chassis. As can be seen from FIG. 4, where the running gear at the rear of the chassis are also identified by reference numeral 30 and the leveling jacks by reference number 31. An important feature of the present invention resides in the fact that the leveling jacks all have operating strokes which are sufficient to position than the excavating unit 10 for excavating to thereby provide that the excavator can recover roadway layers to a roadway depth of at least 25 to 33 cm. This is accomplished by setting the leveling jack at the front of the chassis at position in relation to this position of the leveling jacks at the rear of the chassis so that the excavation unit 10 penetrates the worn roadway to a depth of at least 25 to 33 cm. Typically, for example, the excavating unit has a diameter of 1.25 meters and a length of two meters whereby a cutting width of 2.05 meters can be accomplished at the required penetration depth.

The segregating chamber 11 is formed by a part of the housing 24 having a downwardly extending front wall 24A spaced from the roadway at a sufficient distance to the allow passage of layer of cement which has been deposited on the roadway into the chamber. Spaced a short distance above the lower terminal edge of the wall 24A is a series of openings at spaced apart locations transversely across the width of the wall 24A. Each of these openings is provided with a discharge nozzle 24B that is connected to a fluid supply line for discharging water supplied to the second chassis from the water tank 5 on the first chassis. Only a portion of the liquid needed for the mixture of cement and aggregate is supplied by the nozzles 24B. As will be described later, a further quantity of water is supplied to the blending chamber. A segregating blade 24C is secured to housing 24 to limit the free space between the housing 24 and excavator unit 10 thereby allowing segregating the softer roadway material. As the excavator 10 rotates during the releasing operation of material from the roadway, the cutters on helical configuration of the plates 19A and 19C operates to transport the aggregate, comprised of broken pieces of material from the roadway, toward the site of the reversely curved portion 19B. However, at the same time, some of the material released from the roadway will be lifted and carried by a rotation of the drum upwardly from the roadway and discharge rearwardly of the cutting drum 17. Trailing behind the cutting drum is a scrapper blade 11C which serves to recover any residual material escaping rearwardly beyond the excavator drum. The scrapper blade 11C is attached to a forward end portion of a housing 14A which is elongated to extend centrally along the chassis elongated in direction of advancing movement of the chassis.

The blender unit 14 is situated inside the elongated housing 14A thereby forming a blending chamber. The housing 14A is provided with support bars 14B extending vertically along the outer surface of the housing at the forward and aft locations. The bars 14B, are each provided with a roller 14C, at its projected upper end, the rollers 14C engage one of two parallel tracks 14D supported by the chassis 3 and extending parallel to the direction of advancing movement by the chassis. The rollers 14C permit withdraw of the blender from a operative position by sliding movement of the housing 14A rearwardly of the chassis to an imperative position for access to a drive motor 69 which is drivingly connected for rotating a blender assembly situated inside the blender housing. The blender assembly includes an elongated drive shaft 28 extending parallel to the direction of advancing movement by the chassis. Arms 29 are mounted onto the shaft 28 and extend radially therefrom. The projected terminal end portions of the arms are each provided with replaceable blades 34. The arms are situated on the shaft 28 in a spiral configuration. Thus, it can be seen that the drive shaft 28 rotates about an axis parallel with the direction of advancing movement by chassis 3 along the existing roadway. The motor 69 is provided with a pulley which is in turn connected by a drive belt to a pulley fastened to an end portion of the drive shaft 28. Rotation of the drive shaft 28 through operation of the motor 69 causes complete mixing of the aggregate and binder, i.e., cement and water, while the blended mixture is advanced rearwardly of the chassis for discharge from the blender. The motor 69 is connected to a suitable control by which the speed of rotation of the shaft 28 of the blender arms can be adjusted within limits so that the rate at which the blended mixture is advanced along the blending chamber can be controlled so as to match the particular features of the material being processed at a given a roadway reconditioning site. There is nozzle 24D supported by a housing wall of the blender unit 14 and connected to receive water withdrawn from the water tank on chassis 1. The total desired quantity of water is introduced to the aggregated cement by the combined discharge from nozzles 24B and 24D.

Figure 9:
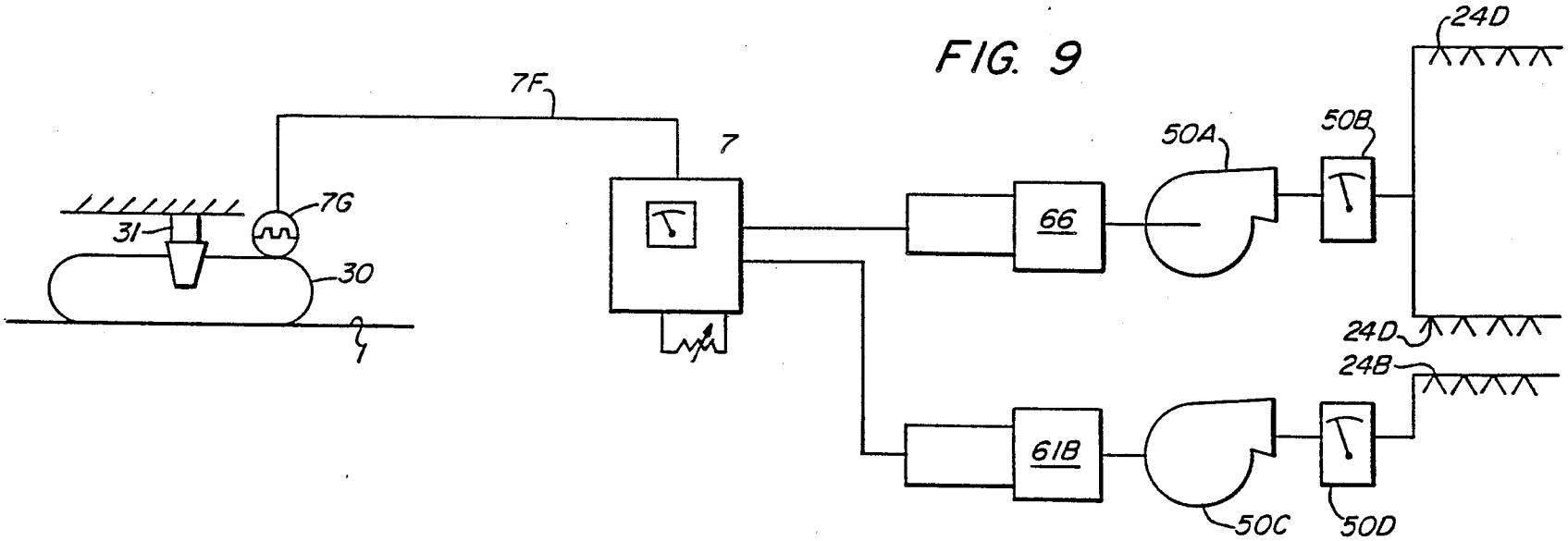
FIG. 9 is a schematic illustration of a control for selecting a predetermined quantity of water to be dispersed for mixture and cement.

On chassis 3 there is preferably provided a water discharge control system which is illustrated in FIG. 9. The nozzles 24C in the blending chamber are connected to receive water from a first proportioning pump 50A having its output line connected to a flow control meter 50B that in turn delivers the desired proportion of water to the nozzles. The pump 50A is driven by a variable speed motor 66 that is in turn controlled by the central control 7 which is provided with a potentiometer or other well known form of adjusting device for matching the quantity of water which is to be discharged by the water discharge system with the speed of advancing movement by chassis 3. Line 7F extends to a speed transducer 7G which is driven by a selected one running gear 30. Central control 7 also delivers a control signal to a drive motor 61B which is drivingly connected to a pump 50C for delivering water through a flow control meter 50D and then to discharge nozzles 24B in the segregating chamber. The central control unit 7 contains a calculator or a processor to correlate the forward speed of chassis 3 and the desired quantity of water which is required for producing a final desired consistency of blended cement and aggregate mixture per square meter of roadway.

The blended mixture of aggregate, cement and water is received from the blender unit by a spreading screw 15 which includes a helical blade portion secured to a shaft 35 that extends transversely of the chassis 3 thus transversely to the direction of forward movement by the chassis. The spreading screw is driven by a hydraulic motor, not shown, to rotate the screw and thereby spread the homogenized material which is supplied to the roadway at a height H defined by an adjustably height leveling blade 16. The blender unit, spreader screw 15 and leveling blade 16 are preferably embodied as a unitary assembly that is mounted by the upwardly extending support bars 14B on the track 14D. In this way the units which are supported by the housing 14A are capable of movement lengthwise of the chassis for providing access to the blending chamber; spreader screw and leveling blade for the purpose of cleaning these members.

While the present invention has been described in connection with the preferred embodiments of the various figures, it is to be understood that other similar embodiments may be used or modifications and additions may be made to the described embodiments for performing the same function of the present invention with deviating therefrom. Therefore, the present invention should not be limited to any single embodiment, but rather construed in breadth and scope in accordance with the recitation of the appended claims.

What I claim is:

1. A road reconditioning plant for excavating an existing roadway and using excavated roadway material for forming a renewed roadway, said road reconditioning plant having upstream and downstream ends relative to said existing roadway and including the combination of;

excavating means arranged at the upstream end of said plant capable of releasing existing roadway material to a depth of at least about 25 cm while subdividing released material to form aggregate;

first chassis means carrying said excavating means for advancing movement along said roadway;

drive means for advancing said chassis means along said existing roadway;

adjustable leveling means on said chassis means located at said upstream and downstream ends spaced from said excavating means for positioning said excavating means to excavate roadway material to a depth of at least about 25 cm in its ambient condition;

housing means including a blade member spaced from said excavating means at said downstream end for forming a segregating chamber wherein released roadway material can pass in a downstream direction beyond said excavating means;

blending means for receiving aggregate discharge from said excavating means, said blending means receiving cement and water for forming a binder to be blended with aggregate while advanced rearwardly along said chassis means in relation to the direction of forward advancing movement by the chassis means;

means at the downstream end of said chassis means for discharging blended aggregate and binder from said blending means onto the excavated roadway;

said means at the downstream end of said chassis means including a spreader screw having an axis of rotation transversely of said chassis relative to the direction of the advancing movement thereby, said spreader screw being mounted on said chassis rearwardly of said blending means, and an adjustable leveling blade for adjustably selecting the depth of blended aggregate and binder distributed to the excavated roadway at the rear of said chassis means;

a second housing means supported by said chassis for movement therealong between operative and rearwardly situated inoperative positions to provide access to said blending means, said second housing means supporting said blending means, said spreader screw and said adjustable leveling blade, and track means carried by said chassis, and carrier arms for interconnecting track means with said second housing means.

2. The road reconditioning plant according to claim 1 wherein said excavating means includes a drive drum supported by shaft members to rotate about an axis extending transversely of said chassis means in relation to the direction of advancing movement thereby along a roadway, spiral shaped means forming cutting elements said spiral shaped means supported by said drum, and means at each ends of said drum for supporting other cutting elements.

3. The road reconditioning plant according to claim 2 wherein said spiral shaped means includes two spiral sections, one of which section is a reverse spiral configuration of the other section, and a reversely bent section interconnecting terminal end portions of the two spiral sections.

4. The road reconditioning plant according to claim 2 wherein said means at opposite ends of said drive drum include a carrier ring secured to each of opposite end portions of said drive drum, arcuate carrier segments for supporting cutter elements, means for releasably securing said arcuate segments and said cutters supported thereby to said carrier ring.

5. The road reconditioning plant according to claim 1 wherein said blending means includes a drive shaft arranged to rotate about an axis extending generally parallel with the direction of advancing movement along the existing roadway by said chassis means, blender arms projecting radially from said drive shaft, and blade means fastened to projecting ends of said arms.

6. The road reconditioning plant according to claim 5 further including means for replaceably attaching said blade means to said arms.

7. The road reconditioning plant according to claim 5 wherein said arms project radially from said drive shaft at sites forming a spiral configuration for advancing aggregate and binder rearwardly along said chassis while said binder and aggregate are blended.

8. The road reconditioning plant according to claim 1 further including rollers carried by end portions of sand carrier arms projecting from said second housing means.

9. The road reconditioning plant according to claim 1 further including a second chassis means for advancing movement along said existing roadway in advance of said first chassis means, a cement hopper and a water tank carried by said second chassis means, cement proportioning cells for discharging a predetermined quantity of cement from said cement hopper to said existing roadway, means for discharging predetermined quantities of water from said water tank for mixing with cement and aggregate in said blender means.

10. The road reconditioning plant according to claim 9 wherein said means for discharging a predetermined quantity of water includes a central control responsive to advancing movement by said first chassis, and a proportioning pump controlled by said central control.

11. The road reconditioning plant according to claim 10 further including drive means for controlling the discharge of cement by said proportioning cells, means for providing the signal to said means for controlling the discharge corresponding to the rate of advancing movement by said second chassis along said existing roadway.

12. The road reconditioning plant according to claim 9 wherein said cement proportioning cells including a drive unit extending between generally opposite disposed tube segments at an outlet opening in said cement hopper, said drive unit including a drive shaft to rotate about an axis extending transversely to the direction of advancing movement by said second chassis along said existing roadway, and bars carried by said drive shaft to project radially therefrom at equally distant sites to form proportioning cells between adjacent bars.

13. The road reconditioning plant of claim 1 wherein said drive means includes at least one running gear connected to said leveling means, said running gear engages said existing roadway for advancing said chassis means therealong and said leveling means are supported by said chassis means.

14. The road reconstruction plant of claim 13 wherein said leveling means includes at least one leveling jack having an operating stroke sufficient to adjust said chassis means with respect to said running gear to position said excavating means to excavate roadway material to a depth of at least about 25 .

15. The road reconditioning plant according to claim 1 further including a second housing means supported by said chassis for movement therealong between a forward and rearward position relative to the forward operating direction of said road reconditioning plant, said second housing means supporting said blender unit, said spreader screw and said adjustable leveling blade.

16. A road reconditioning plant for excavating an existing roadway and using excavated roadway material for forming a renewed roadway, said road reconditioning plant having upstream and downstream ends relative to said existing roadway and including the combination of;

excavating means arranged at the upstream end of said plant capable of releasing existing roadway material to a depth of at least about 25 cm while subdividing released material to form aggregate;

first chassis means carrying said excavating means for advancing movement along said roadway;

drive means for advancing said chassis means along said existing roadway;

adjustable leveling means on said chassis means located at said upstream and downstream ends spaced from said excavating means for positioning said excavating means to excavate roadway material to a depth of at least about 25 cm in its ambient condition;

housing means including a blade member spaced from said excavating means at said downstream end for forming a segregating chamber wherein released roadway material can pass in a downstream direction beyond said excavating means;

blending means for receiving aggregate discharge from said excavating means, said blending means receiving cement and water for forming a binder to be blended with aggregate while advanced rearwardly along said chassis means in relation to the direction of forward advancing movement by the chassis means;

means at the downstream end of said chassis means for discharging blended aggregate and binder from said blending means onto the excavated roadway;

said means at the downstream end of said chassis means including a spreader screw having an axis of rotation transversely of said chassis relative to the direction of the advancing movement thereby, said spreader screw being mounted on said chassis rearwardly of said blending means, and an adjustable leveling blade for adjustably selecting the depth of blended aggregate and binder distributed to the excavated roadway at the rear of said chassis means, and a second housing means supported by said chassis for movement therealong between forward and rearward positions relative to the forward operating direction of said road reconditioning plant, said second housing means supporting said blending means, said spreader screw and said adjustable leveling blade.

* * * * *